US005230408A

United States Patent [19]

Sadow

[11] Patent Number: 5,230,408

[45] Date of Patent: Jul. 27, 1993

[54] AUTOMATICALLY EXTENDING ANTI TIP-OVER DEVICE FOR WHEELED LUGGAGE

[75] Inventor: Bernard D. Sadow, Chappaqua, N.Y.

[73] Assignee: Imports by Brian Incorporated, Mt. Kisco, N.Y.

[21] Appl. No.: 932,720

[22] Filed: Aug. 19, 1992

Related U.S. Application Data

[63] Continuation-in-part of Ser. No. 881,401, May 11, 1992.

[51] Int. Cl.[5] ..... A45C 13/26

[52] U.S. Cl. ..... 190/18 A; 280/37; 280/646; 280/655; 280/755

[58] Field of Search ..... 280/40, 35, 37, 655, 280/755, 652, 646; 190/18 A, 18 R; 248/130, 291

[56] References Cited

U.S. PATENT DOCUMENTS

| | | | |
|---|---|---|---|
| 610,061 | 8/1898 | Kirkpatrick . | |
| 616,384 | 12/1898 | Williams . | |
| 2,002,836 | 5/1935 | Rossi . | |
| 2,096,768 | 10/1937 | Styll . | |
| 2,392,926 | 1/1946 | Kelly . | |
| 2,437,029 | 3/1948 | Howard . | |
| 2,510,754 | 6/1950 | Norlin . | |
| 2,581,417 | 1/1952 | Jones . | |
| 2,596,578 | 5/1952 | McIntyre et al. . | |
| 2,599,354 | 6/1952 | Stableford | 280/646 |
| 2,629,607 | 2/1953 | Roubeck | 280/35 |
| 2,654,421 | 10/1953 | Neff | 280/35 |
| 2,767,995 | 10/1956 | Stout . | |
| 3,057,636 | 10/1962 | D'ettorre et al. | 280/37 |
| 3,397,898 | 8/1968 | Denney et al. | 280/755 |
| 3,522,955 | 8/1970 | Warner, Jr. . | |
| 3,526,921 | 10/1970 | Aupke . | |
| 3,557,916 | 1/1971 | Stowell . | |
| 3,606,372 | 9/1971 | Browning . | |
| 3,655,215 | 4/1972 | Becklin . | |
| 3,871,676 | 3/1975 | Renard et al. | 280/35 |
| 3,997,038 | 12/1976 | Walker | 190/18 A |
| 4,036,336 | 7/1977 | Burltley . | |
| 4,062,429 | 12/1977 | Tabor et al. | 190/18 A |
| 4,354,583 | 10/1982 | Walker | 190/18 A |
| 4,508,202 | 4/1985 | Siegert . | |
| 4,538,709 | 9/1985 | Williams et al. | 190/18 A |
| 4,714,268 | 12/1987 | Mather et al. | 280/646 |
| 4,758,008 | 7/1988 | Moddejonge | 280/37 |
| 4,826,194 | 9/1989 | Sakita | 280/755 X |
| 5,010,988 | 4/1991 | Brown . | |
| 5,024,455 | 6/1991 | Schrecongost | 190/18 A X |
| 5,044,476 | 9/1991 | Seynhaeve | 190/18 A |
| 5,048,649 | 9/1991 | Carpenter et al. . | |
| 5,127,662 | 7/1992 | Spak | 280/655 X |

*Primary Examiner*—Allan N. Shoap
*Assistant Examiner*—Christopher J. McDonald
*Attorney, Agent, or Firm*—Abelman Frayne & Schwab

[57] ABSTRACT

An article of wheeled luggage is provided with retractible outriggers that are biased in a direction for them to extend beyond the lateral sides of the article of luggage, thus to provide stabilization for the luggage and militate against accidental tipping over of the luggage during towing of the article of wheeled luggage, the outriggers being movable against the resilient bias, in the event that an arm of the outrigger encounters an obstacle. Dual or multiple such outriggers can be provided for a large article of luggage, the outriggers being interconnected in the form of a parallelogram. A pull cord is provided for retracting the outriggers against the resilient bias for storage of the article of luggage.

10 Claims, 8 Drawing Sheets

FIG. 1
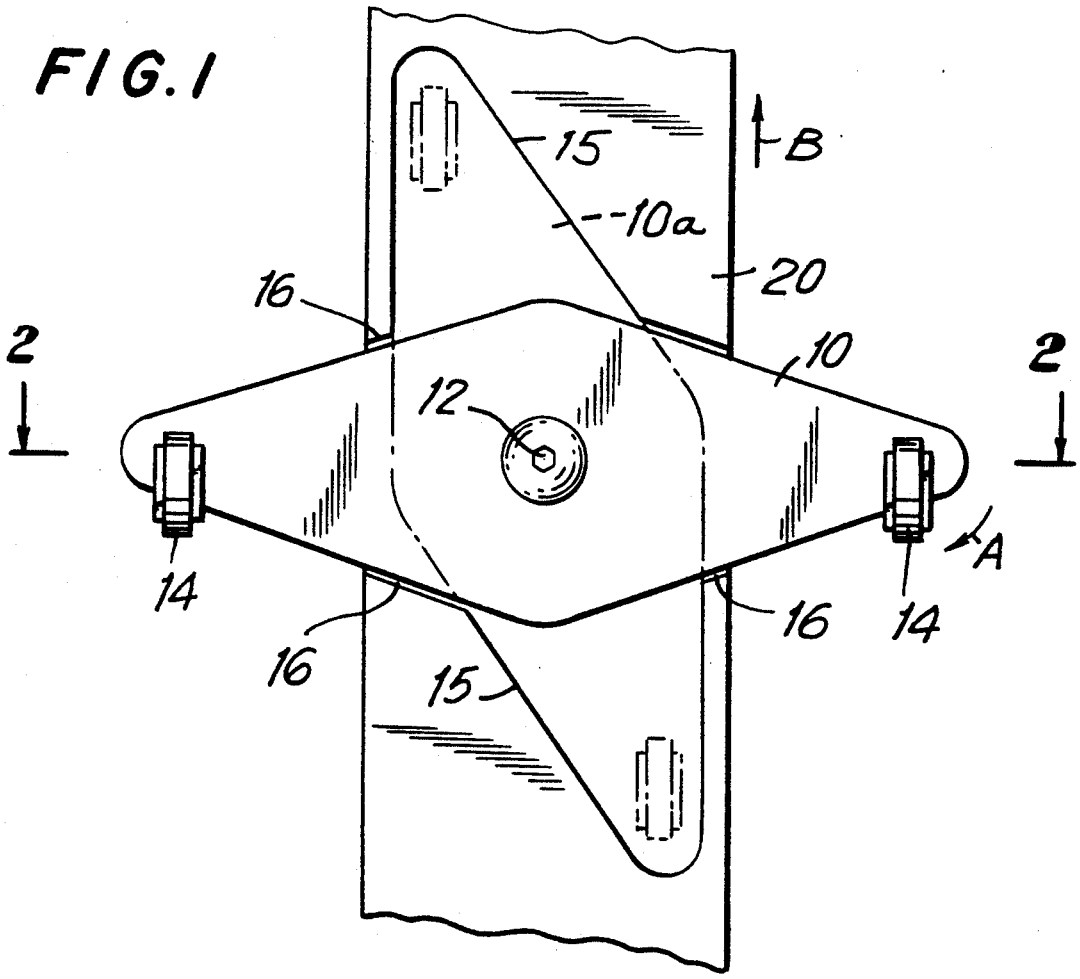
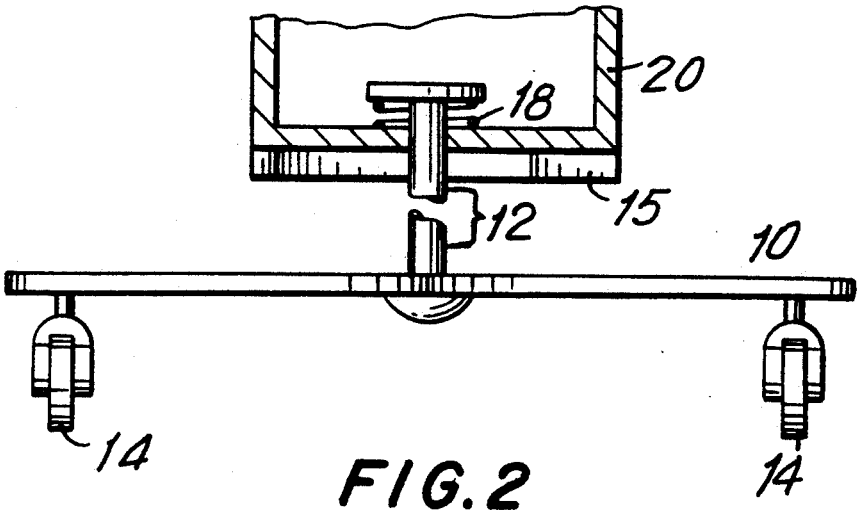
FIG. 2

FIG.6
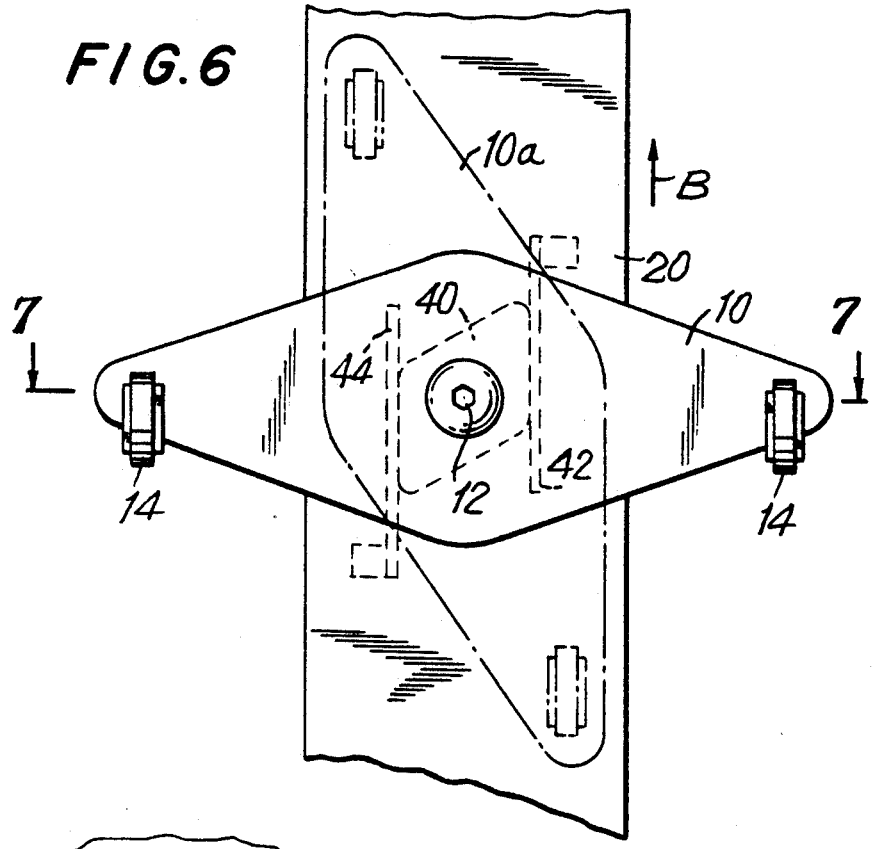
FIG.7
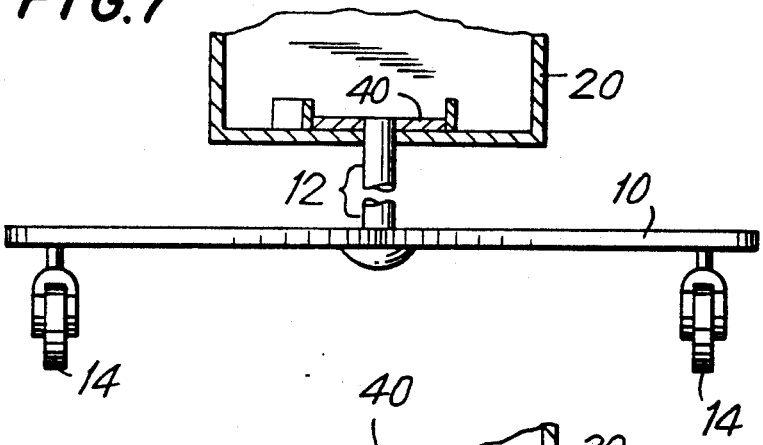
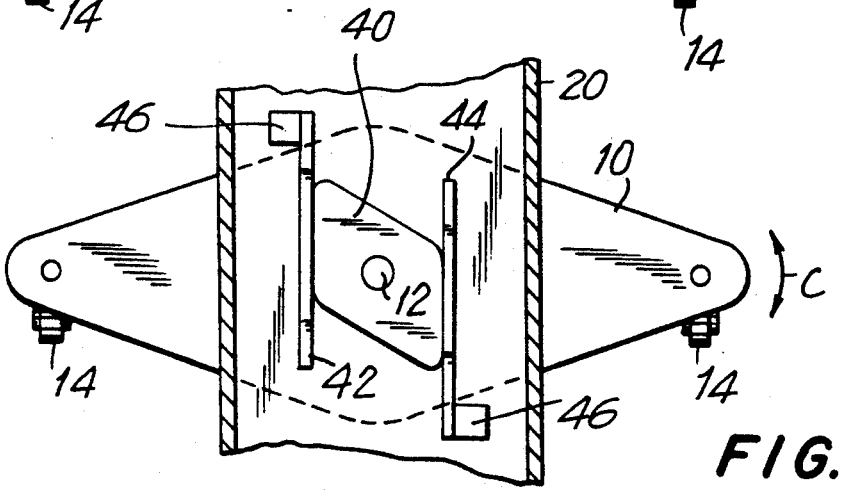
FIG.8

FIG. 9
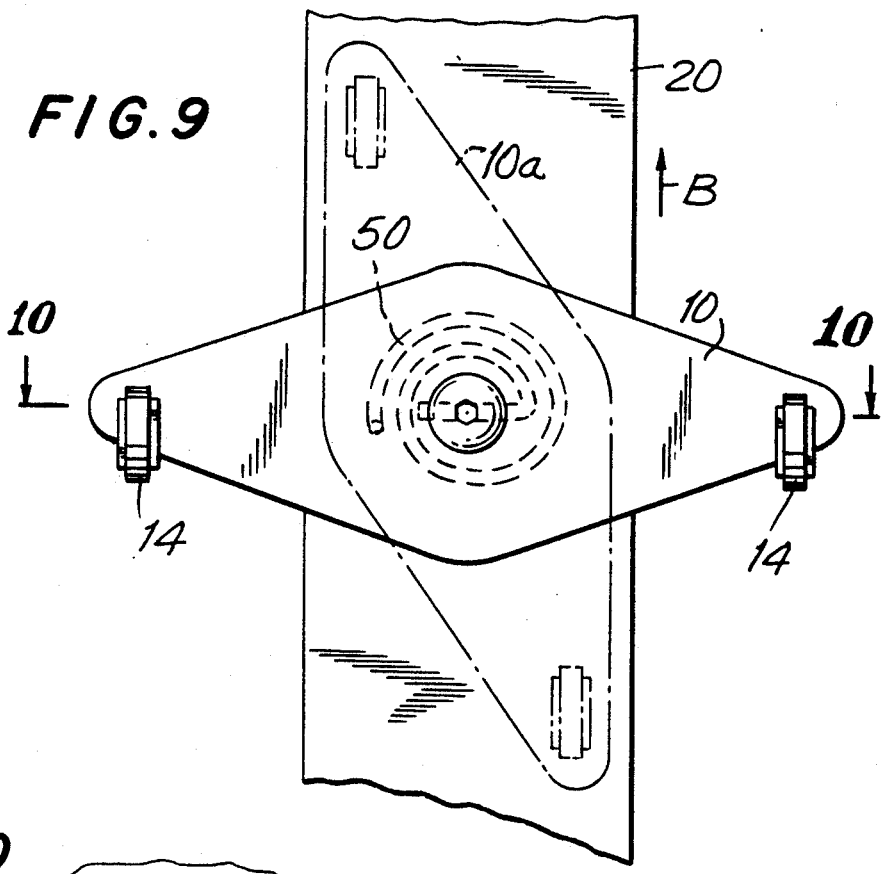
FIG. 10
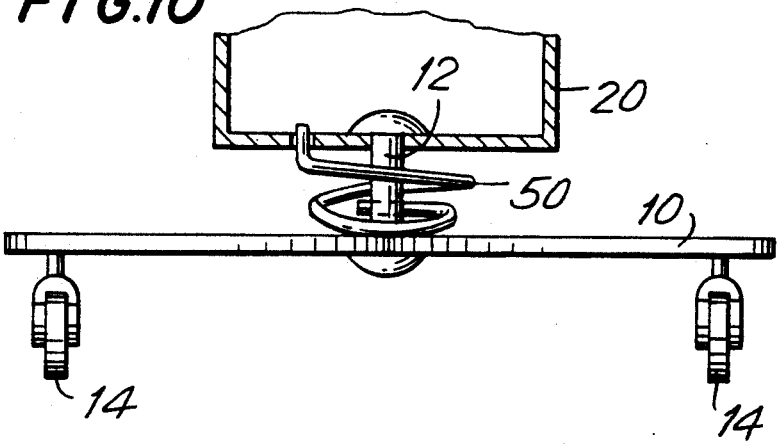
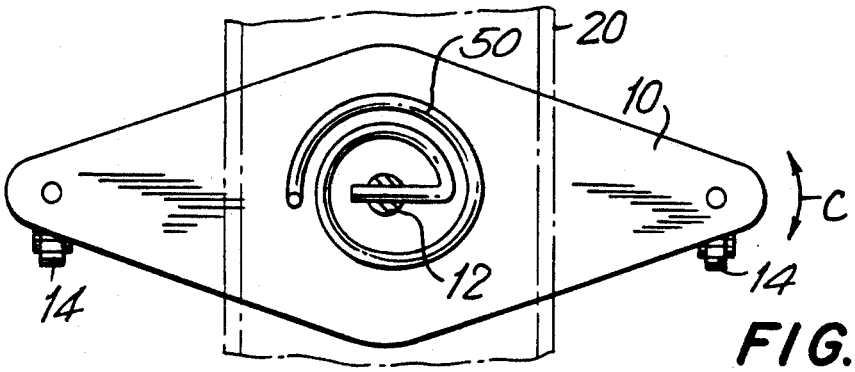
FIG. 11

FIG. 12
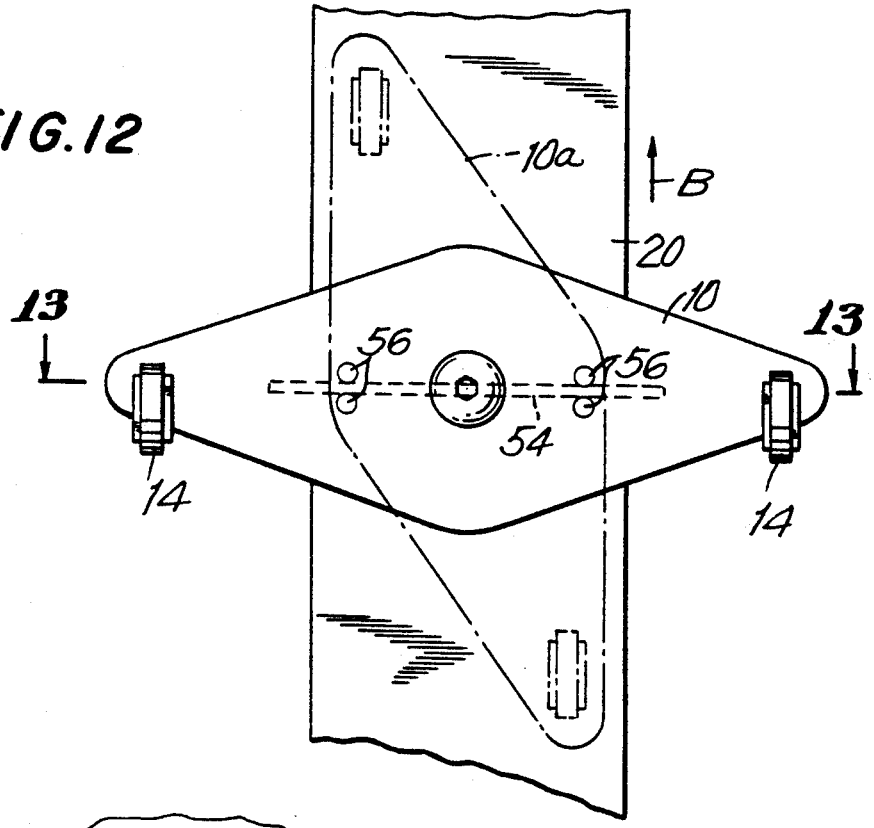
FIG. 13
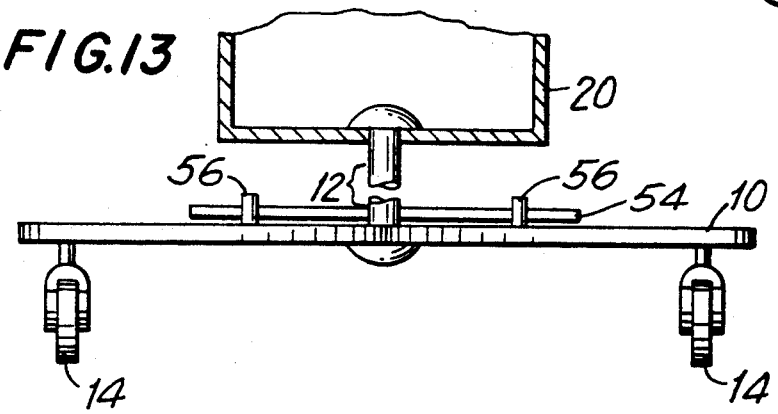
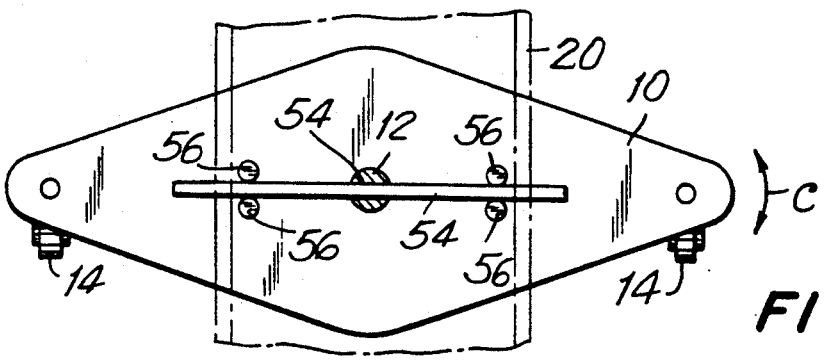
FIG. 14

AUTOMATICALLY EXTENDING ANTI TIP-OVER DEVICE FOR WHEELED LUGGAGE

PARENTAGE OF THE INVENTION

This application is a continuation-in-part of U.S. patent application Ser. No. 881,401 filed May 11th, 1992 in the name of Bernard D. Sadow and entitled "ANTI TIP-OVER DEVICE FOR WHEELED LUGGAGE", which is now pending before the USPTO.

FIELD OF THE INVENTION

Parent application Ser. No. 881,401 discloses an anti tip-over device for wheeled luggage, provided by wheeled outriggers that can be manually moved from a position in which the wheels of the outriggers are confined within the perimeter of the luggage, and, which are manually movable from that position into a position in which the wheels of the outrigger are positioned on opposite lateral sides of the wheeled luggage.

The present invention has for its object to provide a wheeled outrigger for wheeled luggage, which, when in an extended position in which the wheels of the outrigger are positioned spaced from opposite lateral sides of the case, is spring-biased into that position, thus permitting retraction or partial retraction of the outrigger in the event that the outrigger encounters an obstruction. The outrigger thus is spring-loaded into its extended position, as opposed to the rigid mounting of the outrigger when in its extended position as taught in U.S. patent application Ser. No. 881,401.

Further, this invention is concerned with a dual or multiple outrigger construction, in which each of the outriggers is spring-biased into its extended position, and thus, retractible in the event that the outrigger encounters an obstacle.

Further, the present invention relates to an outrigger construction for wheeled luggage that can be manipulated from a location remote from the outrigger, thus making it unnecessary for the user to turn the wheeled luggage on end for the purpose of manually extending the outrigger.

BACKGROUND OF THE INVENTION

Wheeled luggage is well-known in the art, that luggage commonly employing a pair of wheels mounted on separate axles for them to be differentially rotated, those wheels being positioned at a trailing edge of the wheeled luggage during the towing thereof. A single or dual castor wheels are then provided at the leading edge of the wheeled luggage to permit towing of the luggage.

Co-pending application 881,401 discloses to such a construction, and in addition, provides an outrigger structure comprising arms that are manually movable from a first position in which they are located within the confines of the bottom surface of the wheeled luggage, and that are manually movable to a position in which they extend substantially transverse to the bottom surface of the wheeled luggage for the arms to extend beyond the opposite sides of the wheeled luggage, the arms carrying wheeled castors.

Thus, the wheeled outrigger is substantially immovably held both when in its retracted position and in its extended position. In both of these circumstances, difficulties can arise in the event that the outrigger or the castor wheels of the outrigger encounter an immovable object, such as a break in the pavement, or, the outrigger encountering a pole, a chair leg, a door frame, a wall corner, or a person's foot when in the extended position.

SUMMARY OF THE INVENTION

The present invention addresses this problem, more particularly the problem of an arm of the outrigger encountering a fixed obstacle during towing of the article of luggage, the object of the present invention being to provide an outrigger for wheeled luggage in which the outrigger itself is resiliently mounted, such that, in the event that an arm of the outrigger encounters a fixed obstacle, the outrigger can move to permit temporary retraction of that arm and clearing of the obstacle, subsequent to which the outrigger is then restored to its normal extended position after having passed the obstacle.

According to a further feature of the invention, dual outriggers are provided, each of which is resiliently mounted to permit movement of an arm of the outrigger in the event that it encounters a fixed obstacle.

A further object of the invention is to provide an outrigger construction for wheeled luggage that can be moved from a stored position to an extended position from a location remote from the outrigger, with the option of returning the outrigger to its stored position when not needed, again from a position remote from the outrigger.

The first objective is met by providing a resilient member, one end of which is fixed in relation to the wheeled luggage, and the other end of which is fixed to the outrigger, the resilient member being so constructed that it maintains the outrigger in an extended position, the resilient member being placed under the stress in the process of manually moving the outrigger from its extended position to its retracted position.

The resilient member can be provided by one or more leaf springs reacting with a cam fast with the outrigger, or can be a torsion spring, which is placed under torque when the outrigger is moved from its extended position to its retracted position, or, can be provided by elastic members such as coil springs or elastic cord.

In the event that dual or multiple outriggers are provided, a single spring biasing arrangement can be provided for the outrigger assembly, the respective outrigger being interconnected hingedly one with the other by traction rods.

Further, a mechanical linkage can be provided between the outrigger and a member located on the case at a position remote from the outrigger, in order to permit the outrigger to be moved from its retracted position to its extended position, and vice versa, by operation of the mechanical linkage.

DESCRIPTION OF THE DRAWINGS

The invention will now be described with reference to the accompanying drawings illustrating the preferred embodiments of the invention, and, in which:

FIG. 1 is a diagrammatic illustration of an outrigger construction as disclosed in co-pending application Ser. No. 881,401;

FIG. 2 is a diagrammatic cross-section taken on the line II—II of FIG. 1;

FIG. 6 corresponds with FIG. 1, and shows an alternative embodiment of the invention;

FIG. 7 is a diagrammatic cross-section taken on the line 7—7 of FIG. 6;

FIG. 8 is a plan view of FIG. 7;

FIG. 9 is a view again corresponding with FIG. 1, and showing still a further embodiment of the invention;

FIG. 10 is a cross-section taken on the line 10—10 of FIG. 9;

FIG. 11 is a plan view of FIG. 10;

FIG. 12 again corresponds with FIG. 1 and shows a further embodiment of the invention;

FIG. 13 is a diagrammatic cross-section taken on the line 13—13 of FIG. 12;

FIG. 14 is a plan view of FIG. 13;

DISCUSSION OF THE PRIOR DISCLOSURE

Figure 3:
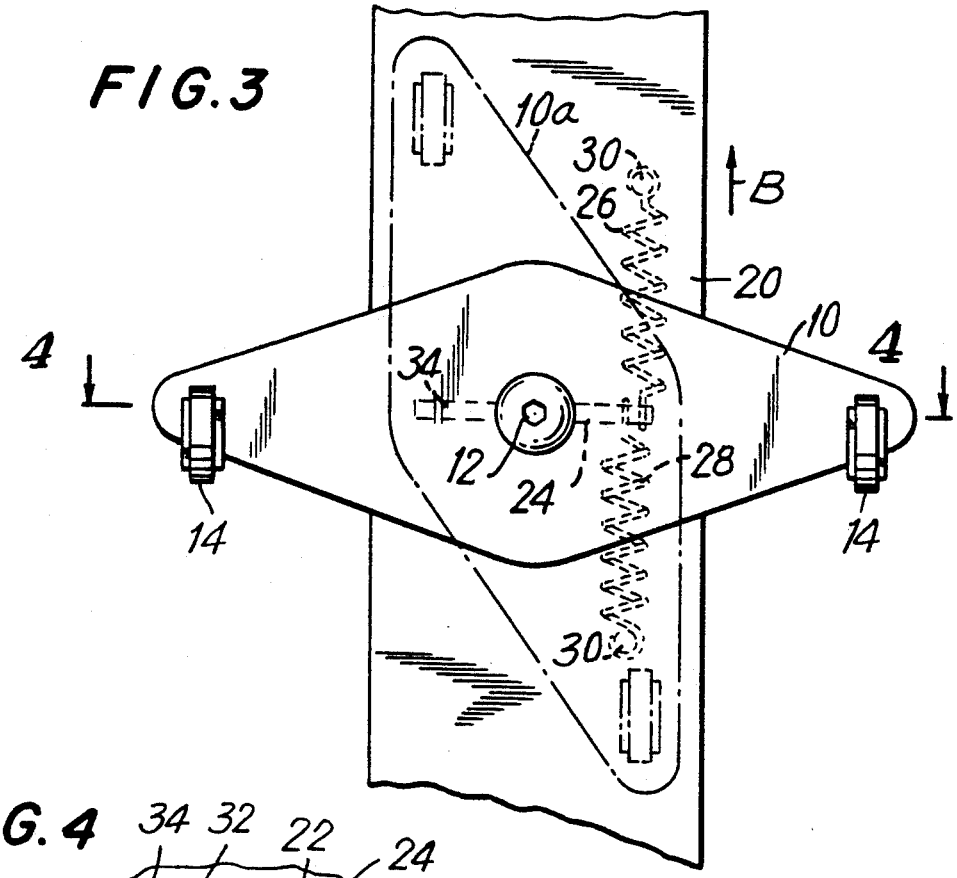
FIG. 3 is an underside view corresponding with FIG. 1, and, showing a modification of FIG. 1 in order for the outrigger to be resiliently biased into a central extended position.

Referring firstly to FIGS. 1 and 2, there is shown an outrigger for wheeled luggage, as disclosed in co-pending application Ser. No. 881,401, and, which is now discussed as the starting point of the present invention.

In FIGS. 1 and 2, an outrigger 10 is pivoted at 12 to the bottom of an article of luggage and has castor wheels 14, the outrigger 10 being rotatable in the direction of the arrows A, from the position shown in full lines to the position shown in chain dotted lines at 10*a*.

As prior disclosed, the outrigger, in both of its positions of adjustment is received within depressions formed in the bottom of the article of luggage, as indicated by the depressions 15, or is otherwise fixedly held, the depressions 15 providing abutments 16 that act to hold the outrigger against rotation when the outrigger has been moved to the extended position shown in FIG. 1. If the user desires to retract the outrigger, the user merely grasps the outrigger 10, pulls it against the force of the spring 18, and then rotates the outrigger to the position shown in chain dotted lines, subsequent to which the outrigger is released and is drawn inwardly into the depressions 15 in which it is retained in a stored position.

However, and as will be immediately apparent, both in the extended position of the outrigger and the stored position of the outrigger, the outrigger is fixedly held against rotational movement.

If the article of luggage 20 is being towed, for example, in the direction of the arrow B with the outrigger 10 in the extended position, then, there is no opportunity of the outrigger moving out of the way in the event that one of the arms of the outrigger strikes an obstruction, such as a pole, a chair leg, or table leg, a door frame or the corner of a wall, or, a persons' foot, the outrigger 10 at that time being positively held against rotation, and thus, being incapable of moving out of the way of the obstruction.

DESCRIPTION OF THE PREFERRED EMBODIMENTS

Figure 4:
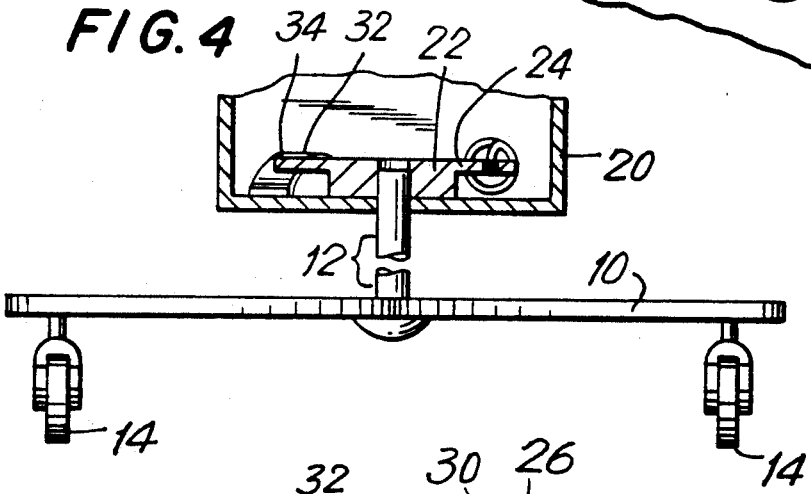
FIG. 4 is a cross-section taken on the line 4—4 of FIG. 3.
Figure 5:
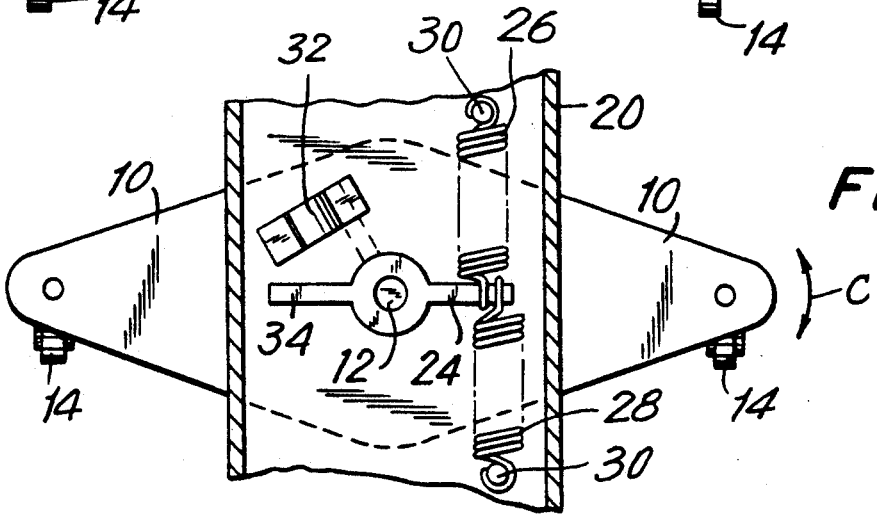
FIG. 5 is a fragmentary plan view of FIG. 4.

Referring to FIGS. 3, 4 and 5, a first embodiment of the present invention is disclosed in which the outrigger is resiliently mounted, and thus, is capable of moving in the directions of the arrows C in FIG. 5.

In FIGS. 3, 4, and 5, the outrigger 10 is rigidly affixed to the pivot pin 12, such that the pivot pin 12 is rotatable in unison with the outrigger 10. The pivot pin 12 at its upper end carries a boss 22 that is rigidly affixed to the pivot pin 12, and similarly is rotatable in unison therewith.

The boss 22 has an arm 24 formed integrally therewith, to which one end of springs 26 and 28 are attached, the other end of the springs 26 and 28 being attached to posts 30 that rigidly affixed to the bottom wall of the article of luggage 20. The tensioning of the springs 26 and 28 is such as to maintain the outrigger 10 in the extended position, in which position it will remain until one or other of the arms of the outrigger 10 strikes an obstruction. In that event, the outrigger 10 will rotate appropriately in a clockwise or a counterclockwise direction, in dependence on which of the arms of the outrigger has hit an obstruction, that movement being permitted by contraction of one of the springs and extension of the other of the springs. The springs 26 and 28 act to spring balance the outrigger 10 resiliently in the extended position, while permitting rotation of the outrigger 10 in the event that such rotation is required. As shown in FIG. 3, rotation in a clockwise direction is required in order to move the outrigger 10 from the extended position to the stored position indicated in chain-dotted lines 10*a*. That movement is permitted by contraction of the spring 28 and extension of the spring 26.

A leaf spring 32 can be provided affixed to the bottom of the article of luggage, which provides a ramp cam surface over which an arm 34 fast with the boss 22 can ride, the spring 32 being of sufficient strength to resist return movement of the outrigger 10 under the force exerted by the spring 26, until such time as the outrigger 10 is given a manual assist in a counterclockwise direction sufficient to overcome the holding force of the spring 32.

FIGS. 6, 7, and 8 show an alternative embodiment of the invention in which the coil springs of FIGS. 3, 4 and 5 are eliminated in their entirety, as is the latching spring 32.

In FIGS. 6, 7 and 8, the outrigger 10 is provided on its upper surface with a rhomboidal cam 40 that is positioned between leaf springs 42 and 44. The leaf springs are held at one end by posts 46 secured to the bottom of the article of luggage, with the leaf springs 42 and 44 in resilient compressive engagement with opposite parallel surfaces of the rhomboidal cam 40. Thus, when in the extended position shown in FIGS. 6, 7 and 8, the outrigger 10 is held in that position by the leaf springs 42 acting in compressive engagement with opposite parallel sides of the rhomboidal cam 40.

If, now, one of the arms of the outrigger 10 encounters an obstruction, the outrigger 10 will be rotated in a clockwise or counterclockwise direction as appropriate, and, in so doing, will cause the rhomboidal cam 10 to deflect the leaf springs 42 and 44 oppositely and outwardly.

When the arm has passed the obstruction, the leaf springs then act to turn the rhomboidal cam 40 and with it the outrigger 10 back to the original position. If, however, it is desired to store the outrigger 10, all that is necessary is to exert a manual force on the outrigger sufficient to move it into the storage position, during which movement maximum flexure of the leaf springs occurs, and, subsequent to which the leaf springs then hold the outrigger 10 resiliently in the stored position.

Another embodiment of the invention is shown in FIGS. 9, 10 and 11, in which the outrigger 10 is rotatably supported on a fixed pivot pin 12, the outrigger being held in its extended position by a torsion spring 50. One end of the torsion spring 50 is anchored in the outrigger 10, and the other end of the torsion spring 50 is anchored in the bottom of the article of luggage 20.

Thus, and as in previous embodiments, if one of the arms of the outrigger 10 strikes an obstacle, the outrigger is capable of rotation in a clockwise or anticlockwise direction, as appropriate, this causing tensioning the spring 50 either in a clockwise or anticlockwise direction. Subsequent to the arm of the outrigger 10 having released itself from the obstruction, the spring 50 then acts to restore the outrigger to is original fully extended position as shown in the drawings. If it desired to move the outrigger 10 to the storage position indicated in chain-dotted lines, this is done by manually rotating the outrigger 10 in a clockwise direction as shown in the drawings, a suitable means being provided for holding the outrigger 10 once it has been moved to the storage position.

Still another embodiment is shown in FIGS. 12 through 14, in which the outrigger 10 is rotatably supported on a fixed pivot pin 12, the pivot pin 12 having a bore 52 therethrough, through which a length of spring wire 54 is threaded, the spring wire then extending between posts 56 fast with the outrigger 10. If necessary, the spring wire 54 can be fixed against axial movement within the bore 52 to maintain it centered.

The spring wire 54, under normal conditions, acts to maintain the outrigger 10 in the fully extended position illustrated. If, however, one of the arms of the outrigger 10 meets with an obstruction, then, as in the previous embodiments, the outrigger can rotate about the axis of the pin 12 in order to permit the arm to pass the obstruction, rotation of the outrigger being permitted by flexure of the spring wire 54.

As in previous embodiments, in the event that it is desired to move the outrigger to the stored position indicated at 10*a*, this can be done manually by rotating the outrigger in a clockwise direction against the force imposed by the spring wire 54, subsequent to which it can be held in position by any appropriate mechanism.

Figure 15:
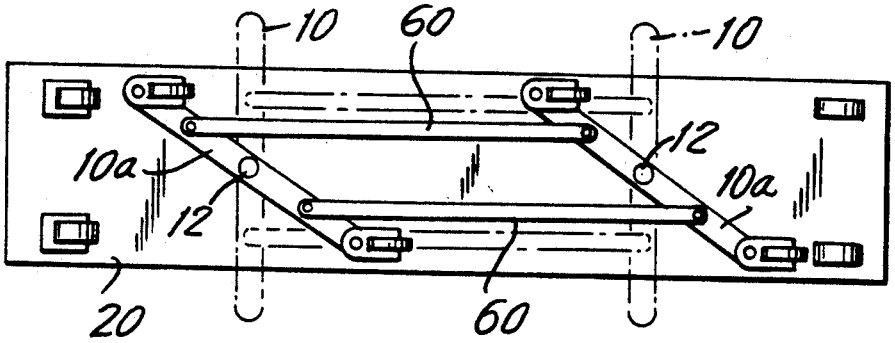
FIG. 15 is a diagrammatic plan view of still a further embodiment of the present invention.

Further stability for the article of wheeled luggage, particularly if the article of wheeled luggage is a particularly large one can be accomplished by the modification shown in FIG. 15, in which dual outriggers are provided, each pivoted to the bottom of the article of luggage, the outriggers 10 being movable from the stored position as shown at 10*a* to the extended position shown in dotted lines at 10, either independently of one another, or, the outriggers can be tied together by rods 60, such that the outriggers 10 move in unison one with the other. In that event, there is need to provide only one of the outriggers 10 with the resilient means previously discussed with respect to FIGS. 3 through 14.

Figure 16:
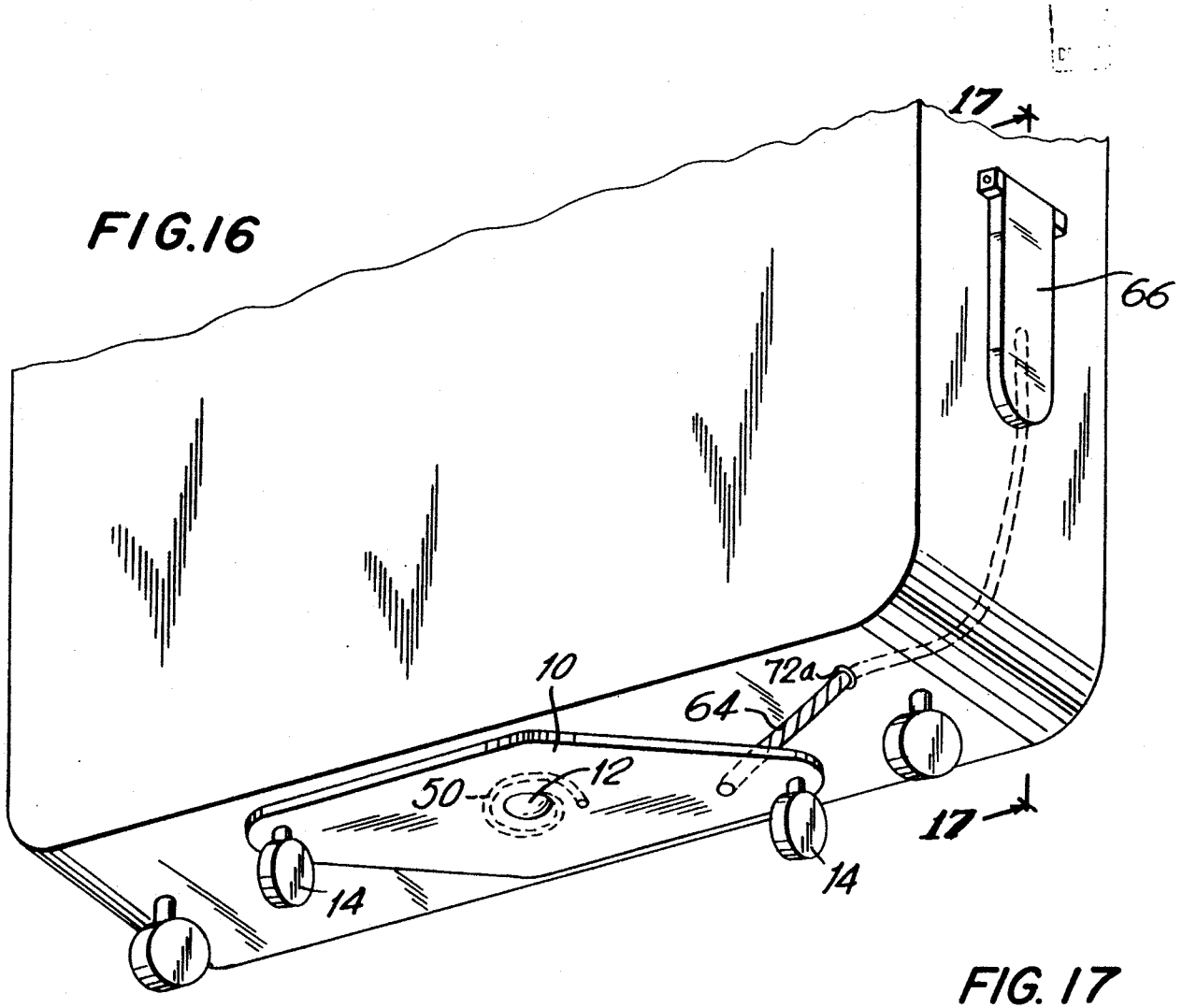
FIG. 16 is a perspective view showing an operator for the outrigger of the previous figures.

Instead of being moved manually between their extended and retracted positions, or vice versa, conveniently, the outrigger 10 can be operated at a remote position as illustrated in FIG. 16 by means of a cord-operated mechanism. As shown in FIG. 16, the outrigger is biased to its extended position by a torsion spring 50, and, is held in the extended position until such time it is desired to retract the outrigger, such as will be required for storage of the luggage.

Figure 17:
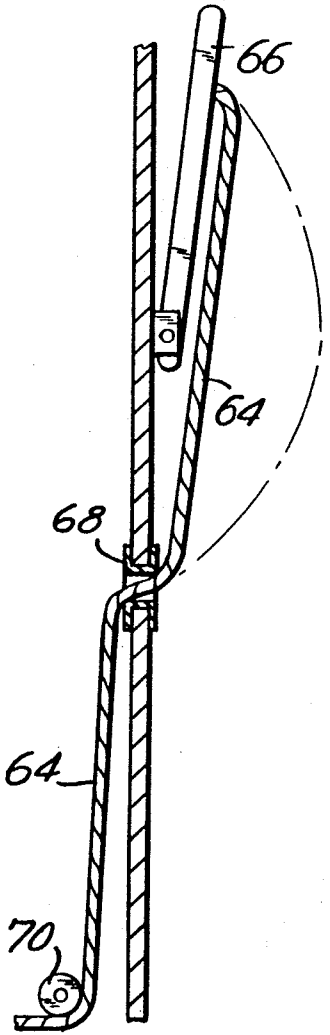
FIG. 17 is a diagrammatic cross-section taken on the line 17—17 of FIG. 16.

To enable this, a cord 64 is attached to the appropriate arm of the outrigger 10, and a pull mechanism 66 is provided for the cord. The pull mechanism 66 can be in the form of a simple hinged lever, which, in the upwards position shown in FIG. 17 maintains the cord in an extended position against the tension of the torsion spring 50, a clip or strap [not shown] being provided for holding the lever 66 in the upwards position shown in FIG. 17.

When it is desired to release the outrigger 10 for it to assume its extended position, the lever 66 merely is moved downwardly, thus permitting the cord 64 to be drawn through the eyelet 68 in the side wall of the article of luggage 20 under the influence of the torsion spring 50. Conveniently, guides or a roller 70 can be provided to assist the cord in its movement, the cord then emerging through an eyelet 72 in the bottom wall of the article of luggage.

Figure 19:
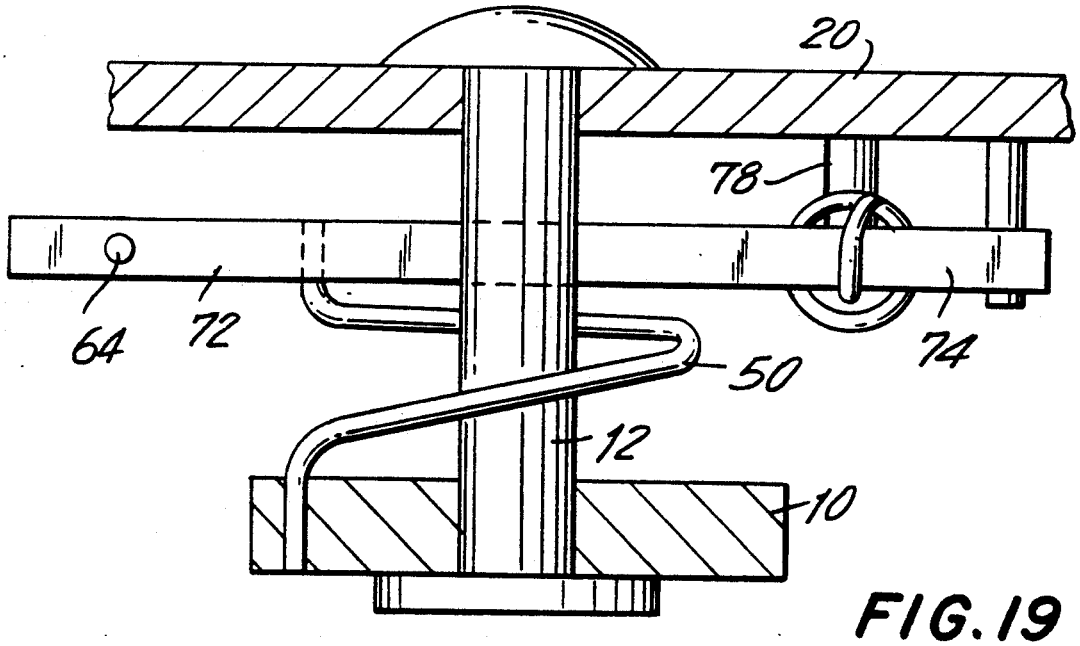
FIG. 19 is a diagrammatic cross-section taken on the line 19—19 of FIG. 18.
Figure 18:
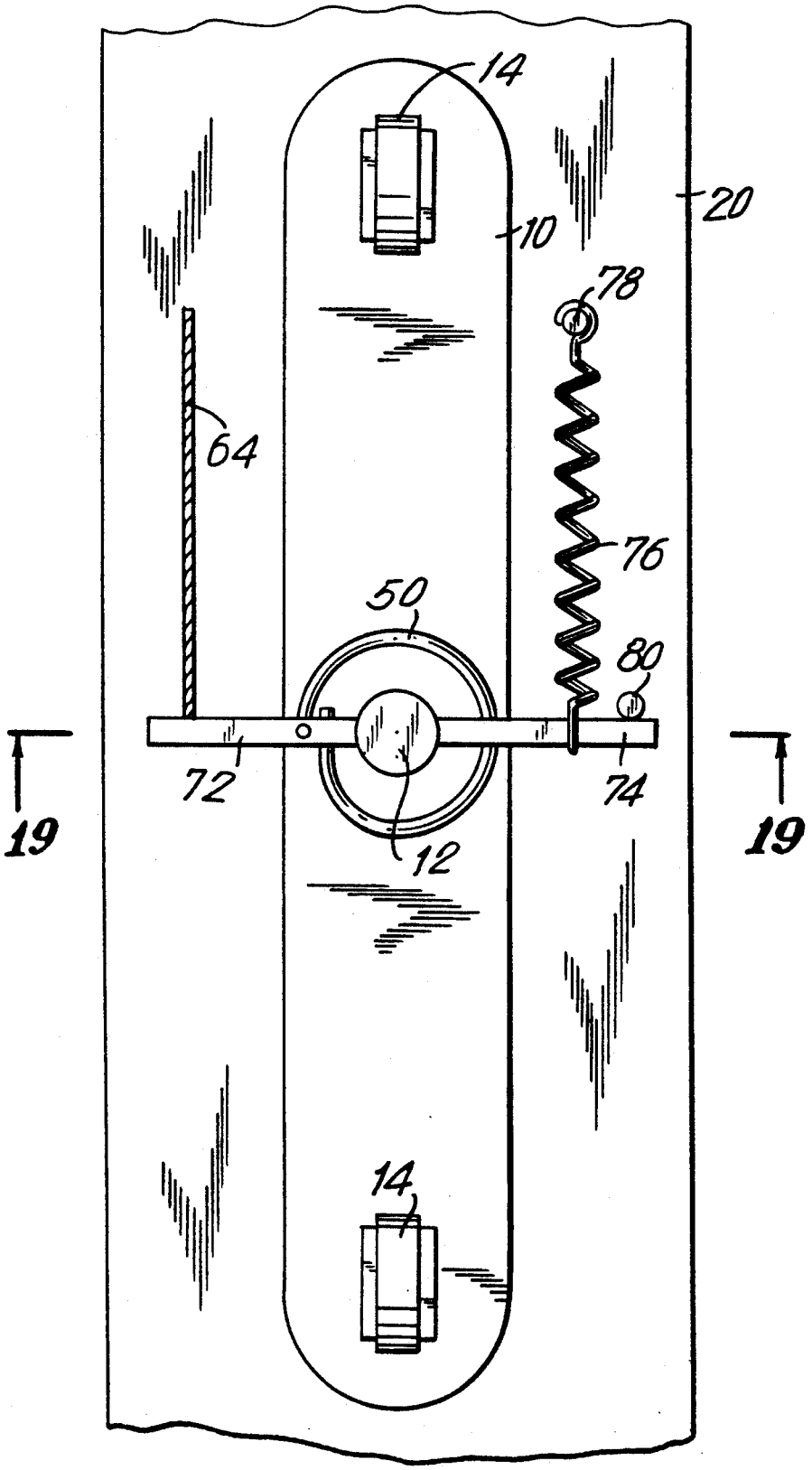
FIG. 18 is a diagrammatic plan view of a different form of cord operated outrigger.

Referring to FIGS. 18 and 19, an alternative form of cord operated mechanism is shown, in which the outrigger 10 normally is held in the stored position. Thus, provision must be made for relative movement between the operating mechanism for the outrigger and the outrigger itself when the outrigger has been moved by the pull cord 64 into the extended position. If such provision is not made, then, the pull cord itself will inhibit rotational movement of the outrigger relative to the support for the outrigger.

As will be seen in FIG. 19, which is an exploded cross-sectional view, the pivot 12 is mounted for rotation relative to the case 20, and, carries oppositely extending bails 72 and 74. The cord 64 is attached to the bail 72, the bail 74 being attached to one end of a coil spring 76, the other end of which is secured to a post 78 secured to the article of luggage 20. Thus, with respect to FIG. 18, the outrigger 10 is at all times biased in a counterclockwise direction and into a position in which the bail 74 is in engagement with a fixed pin 80 mounted on the article of luggage 20. The bails 72 and 74 and the pivot 12 are rotated in a clockwise direction by a pull on the cord 64.

The outrigger 10 is journalled for rotation on the pivoting pin 12, and, is connected to the bail 72 by a torsion spring 50. Thus, without regard to the position of angular orientation of the bails 72 and 74, the outrigger 10 is movable relative thereto by stressing of the torsion spring 50.

Thus, after a pull has been exerted on the pull cord 64, thus moving the bails 72 and 74 and effectively immobilizing them, the outrigger 10 is still free to move relative to the pivot pin 12 and the bails 72 and 74, thus permitting the arms of the outrigger 10 to be moved by an obstruction in the event that they encounter such an obstruction, the outrigger then returning to its original position once the arms have moved free of that obstruction.

Obviously, other known mechanisms can be employed for controlling movements of the cord 64 and for maintaining it under tension.

As is stated at the commencement of this application, this application is a continuation-in-part of parent application Ser. No. 881,401 filed May 11th, 1992, the entire disclosure of which is incorporated into this application by direct reference.

What is claimed is:

1. In an anti tip-over device for an article of wheeled luggage of the type including a rectangular base, a castor wheel at one end of said rectangular base, and ground wheels at an opposite end of said rectangular base providing for the towing of said article of luggage, the improvement comprising at least one bar supported on said base for movement between a first position in which said bar is positioned entirely within the confines of said base, and a second position in which at least one end of said bar is extended laterally beyond a side of said base, said at least one end of said bar supporting a castor wheel engageable with a ground surface over which said article of wheeled luggage is to be towed; and, resilient means for reacting between said base and said bar and operative to resiliently maintain said bar in said second position, whereby, said bar is movable from said second position towards said first position under the influence of forces exerted on said bar by said bar striking an obstruction in the path of said bag during the towing of said article of luggage.

2. The device of claim 1, in which said bar is supported on a pivot for pivotal movement between said first and second positions, and, said resilient means is operative at all times to bias said bar to said second position.

3. The device of claim 1, in which said resilient means is provided by coiled springs attached at one end to said bar, and attached at the other end to said base of said luggage, said coiled springs being in a stretched condition and acting oppositely to each other to bias said bar at all times towards said extended position.

4. The device of claim 1, including a rhomboidal cam attached to said arm about a pivotal axis of said arm, and at least one leaf spring resiliently engaged with said rhomboidal cam, said leaf spring being rigidly attached to said base of said luggage at one end, whereby, angular movement of said arm produces angular movement of said rhomboidal cam against the reaction of said leaf spring, movement of said arm to a stored position resulting in oversetting of said rhomboidal cam relative to said leaf spring, whereby said leaf spring engages the next adjacent linear surface of said rhomboidal cam to resiliently maintain said arm in said stored position.

5. The device of claim 1, in which said resilient means is comprised by a torsion spring, which, in an extended position of said arm, is under zero stress, movement of said arm from said extended position acting to stress said torsion spring, said torsion spring being operative to restore said arm to said extended position upon removal of forces acting to move said arm from said extended position.

6. The device of claim 1, in which said resilient means is provided by a fixed pivot on which said arm is rotatable, and a spring wire supported in said fixed pivot and extending radially thereof, a free end of said spring wire being positioned between posts fast with said arm, said spring wire acting to bias said arm to extended position, and being flexed upon movement of said arm from said extended position, said spring wire during such movement sliding freely between said posts.

7. The device of claim 1, including multiple said bars respectively supported on said base for movement between said first and second positions.

8. The device of claim 7, including at least one connecting rod extending between adjacent said bars, whereby said resilient means operative on one of said bars, is operative to bias the other of said bars to said extended position.

9. The device of claim 1, including a pull cord and tensioning device operative to move said arm from said extended second position to said first position for storage of said article of luggage, and, operative to retain said bar in said first position until the tensioning of said cord is released.

10. The device of claim 1, including a pull cord and a tensioning device operative to move said arm from said first position to said extended second position, and, operative to retain said bar in said second position until tensioning of said cord is released, further including resilient means interposed between said bar and a member moved angularly by said pull cord, whereby said bar is movable against the bias of said resilient means relative to said cord operated actuating member.

* * * * *